US008348088B2

(12) United States Patent
Apps

(10) Patent No.: US 8,348,088 B2
(45) Date of Patent: Jan. 8, 2013

(54) CONTAINER WITH REINFORCED BASE

(75) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 4343 days.

(21) Appl. No.: 11/767,157

(22) Filed: Jun. 22, 2007

(65) Prior Publication Data

US 2008/0314913 A1 Dec. 25, 2008

(51) Int. Cl.
*B65D 90/12* (2006.01)
*B65D 6/28* (2006.01)

(52) U.S. Cl. ..... 220/636; 220/628; 220/627; 220/612

(58) Field of Classification Search ..... 206/386; 108/33; 248/346.5, 346.4; D9/414; 220/636, 220/638, 623, 610, 608, 605, 729, 62.18, 220/601, FOR. 181, FOR. 137, FOR. 132, 220/FOR. 127; *B65D 90/12, 8/06, 8/04, B65D 21/036, 21/032, 21/02, 25/24*

See application file for complete search history.

(56) References Cited

U.S. PATENT DOCUMENTS

| | | | | |
|---|---|---|---|---|
| 3,664,271 | A | 5/1972 | Wolder et al. | |
| 3,727,289 | A | 4/1973 | Bemelmann et al. | |
| 3,733,238 | A | 5/1973 | Long et al. | |
| 3,791,549 | A * | 2/1974 | Delbrouck et al. | 220/555 |
| 3,859,746 | A | 1/1975 | Pecksen | |
| 4,154,641 | A | 5/1979 | Hotton | |
| 4,189,125 | A | 2/1980 | Little | |
| 4,244,471 | A * | 1/1981 | Plante | 206/586 |
| 4,410,099 | A | 10/1983 | deLarosiere | |
| 4,609,120 | A * | 9/1986 | Lauer et al. | 220/605 |
| 4,682,727 | A | 7/1987 | Stoll | |
| 4,701,229 | A | 10/1987 | Arakawa et al. | |
| 4,715,911 | A | 12/1987 | Johansson et al. | |
| 4,801,039 | A | 1/1989 | McCall et al. | |
| 4,856,657 | A * | 8/1989 | Shuert | 206/600 |
| 4,872,574 | A | 10/1989 | Lam | |
| 4,879,956 | A | 11/1989 | Shuert | |
| 4,886,181 | A | 12/1989 | Haines | |
| 4,944,421 | A | 7/1990 | Yurgevich | |
| 4,945,019 | A | 7/1990 | Bowen et al. | |
| 4,948,681 | A | 8/1990 | Zagrodnik et al. | |
| 5,002,841 | A | 3/1991 | Belongia et al. | |
| 5,123,533 | A | 6/1992 | Uitz | |
| 5,244,108 | A * | 9/1993 | Hale | 220/4.33 |

(Continued)

FOREIGN PATENT DOCUMENTS

| | | |
|---|---|---|
| CH | 683 087 | 1/1994 |

(Continued)

OTHER PUBLICATIONS

Translation of DE 19627886 A1 [Korte et al.], Jan. 15, 1998, p. 1.*

(Continued)

*Primary Examiner* — Mickey Yu
*Assistant Examiner* — Robert J Hicks
(74) *Attorney, Agent, or Firm* — Carlson, Gaskey & Olds, P.C.

(57) ABSTRACT

The container includes a floor and a plurality of side walls extending upwardly from the floor. The floor includes a first panel spaced away from a second panel by a plurality of ribs connecting the first panel to the second panel. The ribs each circumscribe an opening through the second panel.

20 Claims, 7 Drawing Sheets

U.S. PATENT DOCUMENTS

| | | | | | |
|---|---|---|---|---|---|
| 5,246,128 | A | | 9/1993 | Uitz | |
| 5,275,302 | A | | 1/1994 | Uitz | |
| 5,397,022 | A | | 3/1995 | Schafer | |
| 5,425,521 | A | | 6/1995 | Locke | |
| 5,685,452 | A | * | 11/1997 | Kristoffersson | 220/608 |
| 5,758,855 | A | * | 6/1998 | Jordan et al. | 248/346.01 |
| 5,791,262 | A | | 8/1998 | Knight et al. | |
| 5,862,935 | A | | 1/1999 | Dubois et al. | |
| 6,076,697 | A | * | 6/2000 | Allabaugh, Jr. | 220/509 |
| D429,052 | S | * | 8/2000 | Ito et al. | D34/38 |
| 6,260,706 | B1 | * | 7/2001 | Koefelda | 206/505 |
| 7,066,477 | B2 | | 6/2006 | Dubois et al. | |
| 2001/0029874 | A1 | * | 10/2001 | Muirhead | 108/57.25 |
| 2003/0183549 | A1 | * | 10/2003 | Verna et al. | 206/509 |
| 2004/0011798 | A1 | | 1/2004 | Dubois et al. | |
| 2004/0200833 | A1 | | 10/2004 | Dubois et al. | |
| 2007/0034540 | A1 | | 2/2007 | Dubois | |

FOREIGN PATENT DOCUMENTS

| | | | | |
|---|---|---|---|---|
| CH | 686 360 | A5 | | 3/1996 |
| CH | 690 678 | | | 12/2000 |
| CH | 691 256 | | | 6/2001 |
| CH | 695 335 | | | 4/2006 |
| DE | 2 122 150 | | | 11/1972 |
| DE | 39 28 265 | | | 2/1991 |
| DE | 296 15 303 | | | 12/1996 |
| DE | 196 27 886 | A1 | | 1/1998 |
| DE | 196 27 887 | A1 | | 1/1998 |
| DE | 298 14 925 | | | 12/1998 |
| DE | 200 04 161 | U1 | | 7/2000 |
| EP | 0 069 419 | | | 1/1983 |
| EP | 0 133 362 | | | 2/1985 |
| EP | 0 729 892 | | | 9/1996 |
| EP | 0 775 637 | | | 5/1997 |
| EP | 0 386 313 | | | 9/1997 |
| EP | 1 207 113 | B1 | | 7/2003 |
| EP | 1 354 807 | | | 10/2003 |
| EP | 1 145 969 | | | 7/2004 |
| EP | 1 473 240 | | | 11/2004 |
| EP | 1 495 937 | | | 1/2005 |
| ES | 2 030 953 | | | 9/1990 |
| GB | 943 947 | | | 12/1963 |
| GB | 2 076 366 | | | 12/1981 |
| GB | 2 241 492 | | | 9/1991 |
| GB | 2255968 | A | * | 11/1992 |
| GB | 2 272 203 | | | 5/1994 |
| GB | 2 255 968 | | | 3/1995 |
| GB | 2 360 762 | | | 10/2001 |
| GB | 2 429 687 | | | 3/2007 |
| JP | 60-146096 | A | | 8/1985 |
| NL | 8201484 | | | 11/1983 |
| WO | 2006/039886 | | | 4/2006 |

OTHER PUBLICATIONS

European Search Report for EP Application No. 08275034.0, Jun. 14, 2010.

Office Action for EP Application No. 08275034.0, mailed on Nov. 28, 2011.

* cited by examiner

CONTAINER WITH REINFORCED BASE

BACKGROUND

The present invention relates generally to containers and more particularly to a container with a reinforced base.

Molded plastic containers are often used for storing and transporting a variety of goods. Many containers include a floor with integrally molded upstanding side walls defining an interior of the container. In order to reinforce the floor, a plurality of ribs are sometimes integrally molded on the under side of the floor. In some applications, it is undesirable to have exposed ribs on the under side of the floor.

SUMMARY

A container according to one embodiment of the present invention includes a plurality of side walls extending upwardly from a floor structure. The floor structure includes a first panel and a second panel spaced from the first panel. A plurality of openings are formed through the second panel. Ribs extend from the first panel to the second panel and circumscribe each of the openings in the second panel.

In another embodiment, a plurality of reinforcement members are secured to a floor of a container. Each reinforcement member includes a panel having a rib extending completely around the periphery of the panel. The reinforcement members abut one another to completely or at least substantially cover a surface of the floor.

These and other features of the application can be best understood from the following specification and drawings, the following of which is a brief description.

DETAILED DESCRIPTION OF THE PREFERRED EMBODIMENT

Figure 1:
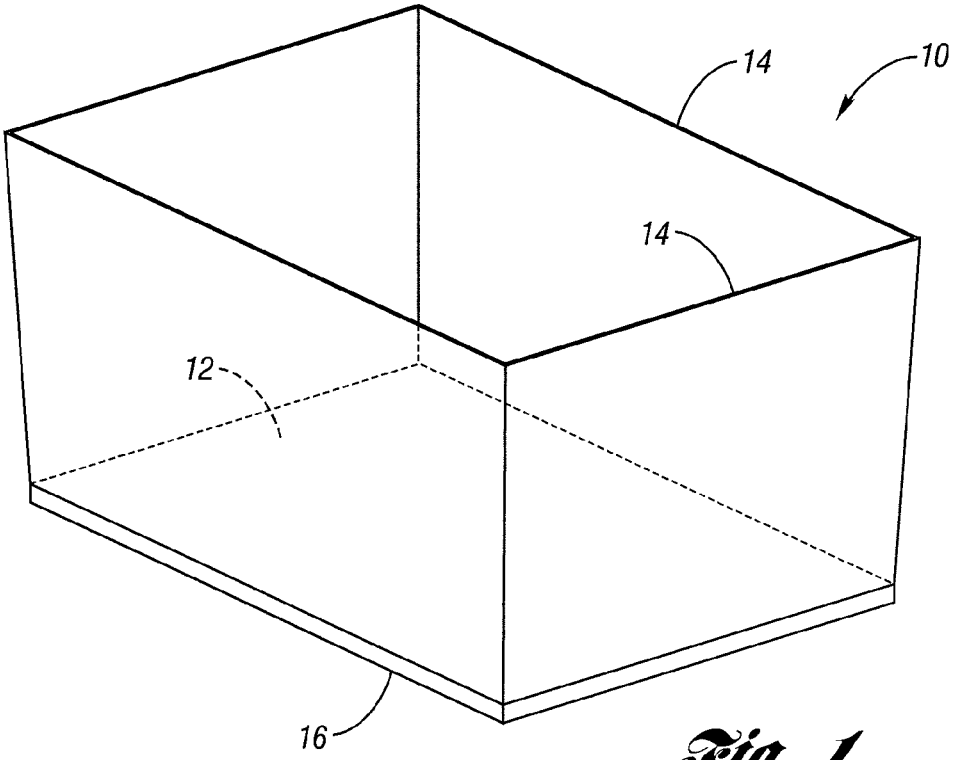
FIG. 1 is a perspective view of a container according to a first embodiment.

A container 10 according to a first embodiment is shown in FIG. 1. The container 10 includes a lower panel or floor 12. A plurality of side walls 14 extend upwardly from a periphery of the floor 12 and are integrally molded with the floor 12. A reinforcement member 16 is secured on the underside of the floor 12. The reinforcement member 16 is injection molded separately and subsequently attached to the floor 12. Together, the floor 12 and the reinforcement member 16 form a floor structure.

Figure 2:
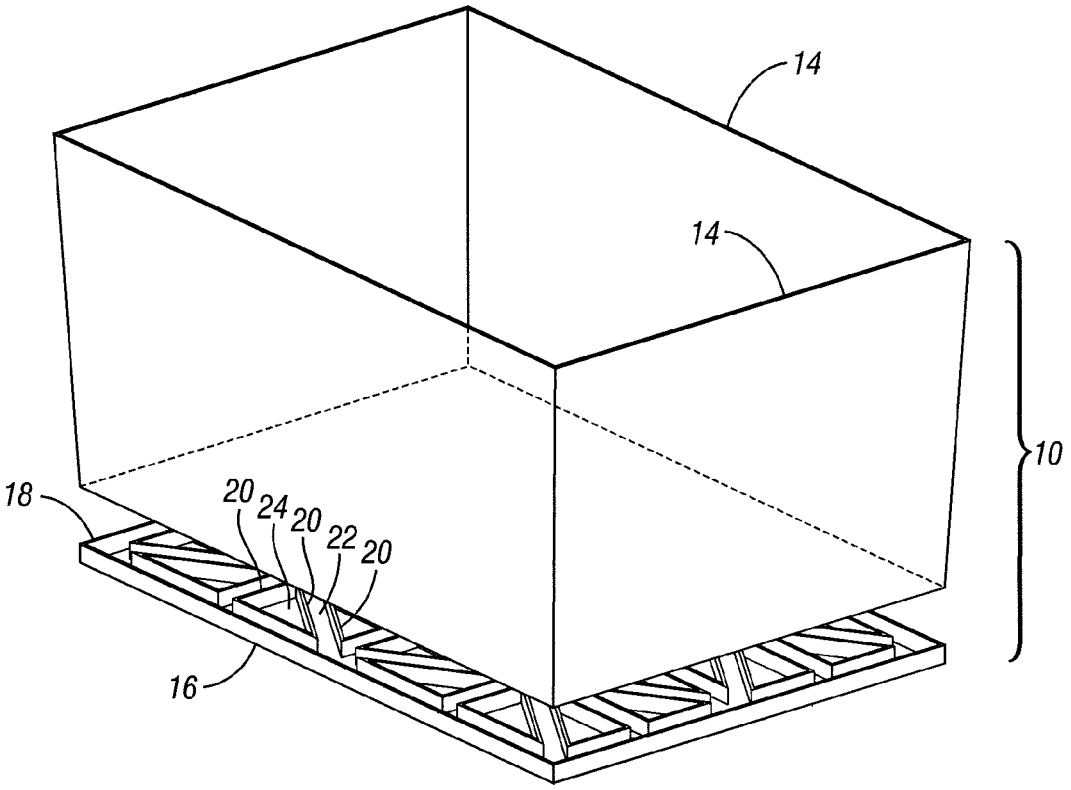
FIG. 2 is an exploded view of the container of FIG. 1.

FIG. 2 is an exploded view of the container 10. The reinforcement member 16 includes a plurality of ribs 20 extending upwardly from a panel 22. The panel 22 includes a plurality of openings 24 therethrough. The ribs 20 circumscribe each of the openings 24. In this particular embodiment, each of the openings 24 is triangular in shape. A peripheral rib 18 circumscribes the periphery of the reinforcement member 16.

Figure 3:
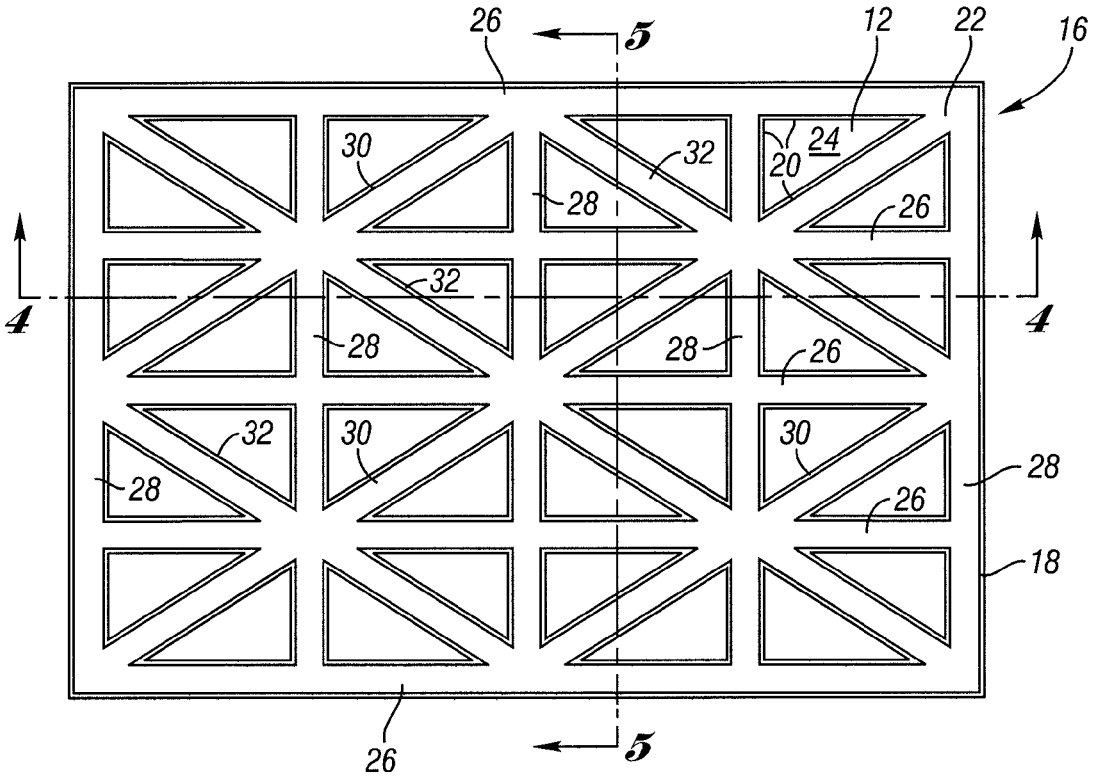
FIG. 3 is a top view of the reinforcement member of the container of FIG. 1.

FIG. 3 is a top view of the reinforcement member 16. The plurality of triangular openings 24 through the panel 22 of the reinforcement member 16 form a pattern in the panel 22 that can be described in several different ways. One way of describing the panel 22 is that it includes a plurality of continuous longitudinal portions 26 (in this example, 5) and a plurality of continuous lateral portions 28 (in this example, 5) intersecting the longitudinal portions 26. The panel 22 further includes a plurality of continuous first diagonal portions 30 and a plurality of second diagonal portions 32 (extending transversely to the first diagonal portions 30). The peripheral ones of the longitudinal portions 26 and the lateral portions 28 for a continuous peripheral portion of the panel 22. In this embodiment, all of the portions of the panel 22 are uninterrupted by ribs and the ribs 20 only circumscribe the openings 24, which in this example are triangular. The peripheral rib 18 extends continuously and completely around the periphery of the panel 22.

Figure 4:
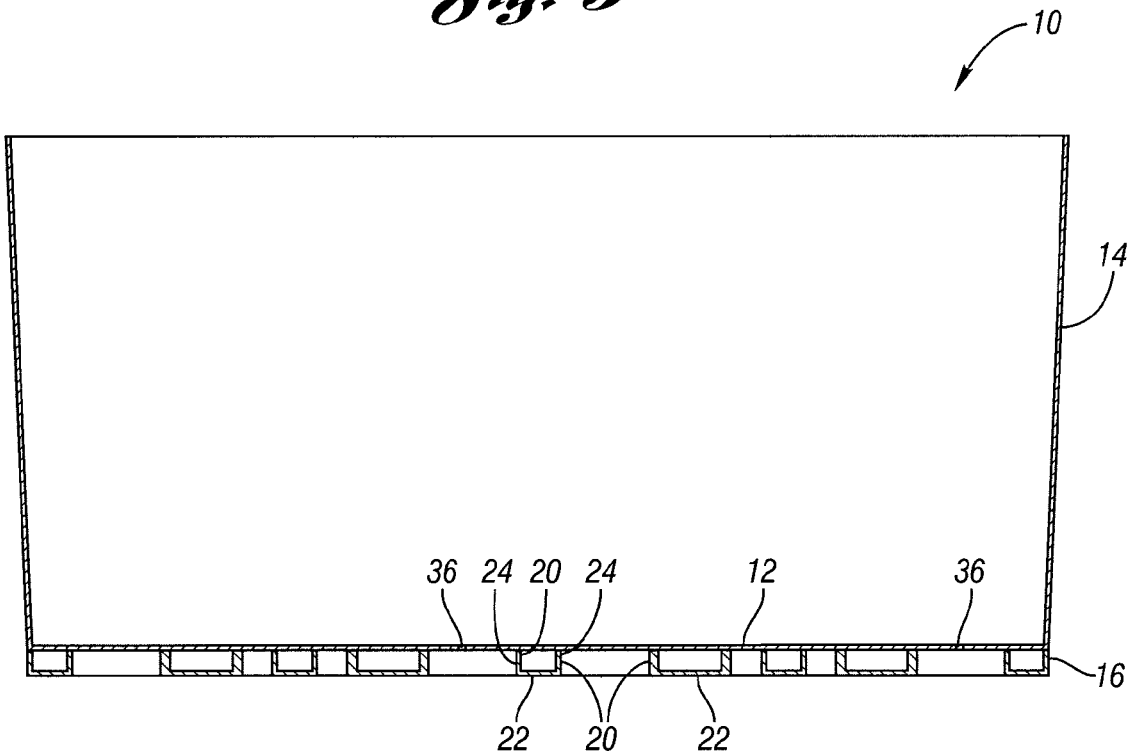
FIG. 4 is a section taken along line 4-4 of FIG. 3 through the container of FIG. 1.

Referring to FIG. 4, the reinforcement member 16 is connected to an underside of the floor 12, such as by vibration welding, hot plate welding, adhesives or other methods. The ribs 20 extend from the floor 12 to the panel 22 and define the openings 24 that expose portions of the underside of the floor 12. The ribs 20 and panel 22 reinforce the floor 12, without unduly increasing the overall weight of the container 10. Drain holes 36 can be optionally provided through the floor 12 in alignment with the openings 24 in the reinforcement member 16.

Figure 5:
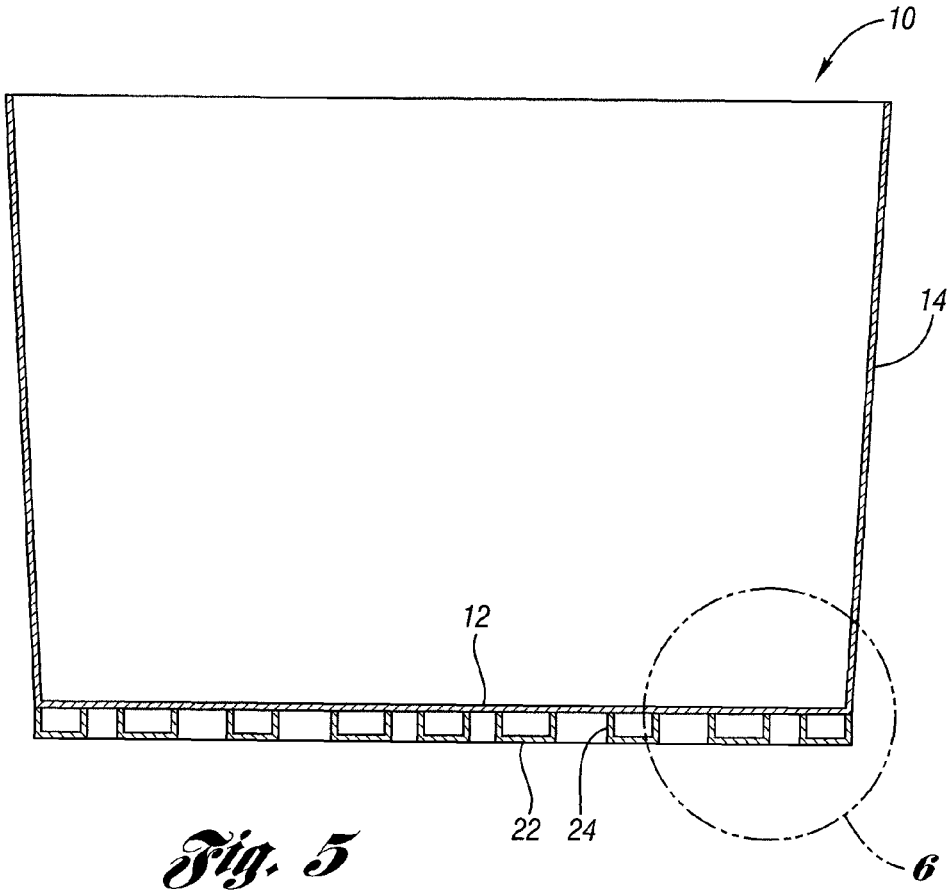
FIG. 5 is a section taken along line 5-5 of FIG. 3 through the container of FIG. 1.
Figure 6:
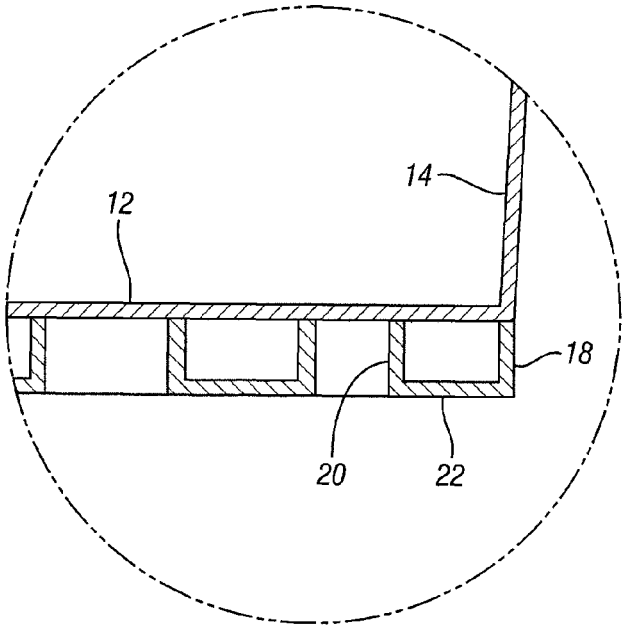
FIG. 6 is an enlarged view of the area 6 of FIG. 5.

FIG. 5 is a section view taken along 5-5 of FIG. 3. As shown in FIG. 5, and in an enlarged view in FIG. 6, the floor 12 is reinforced by the ribs 20 in several directions.

Figure 7:
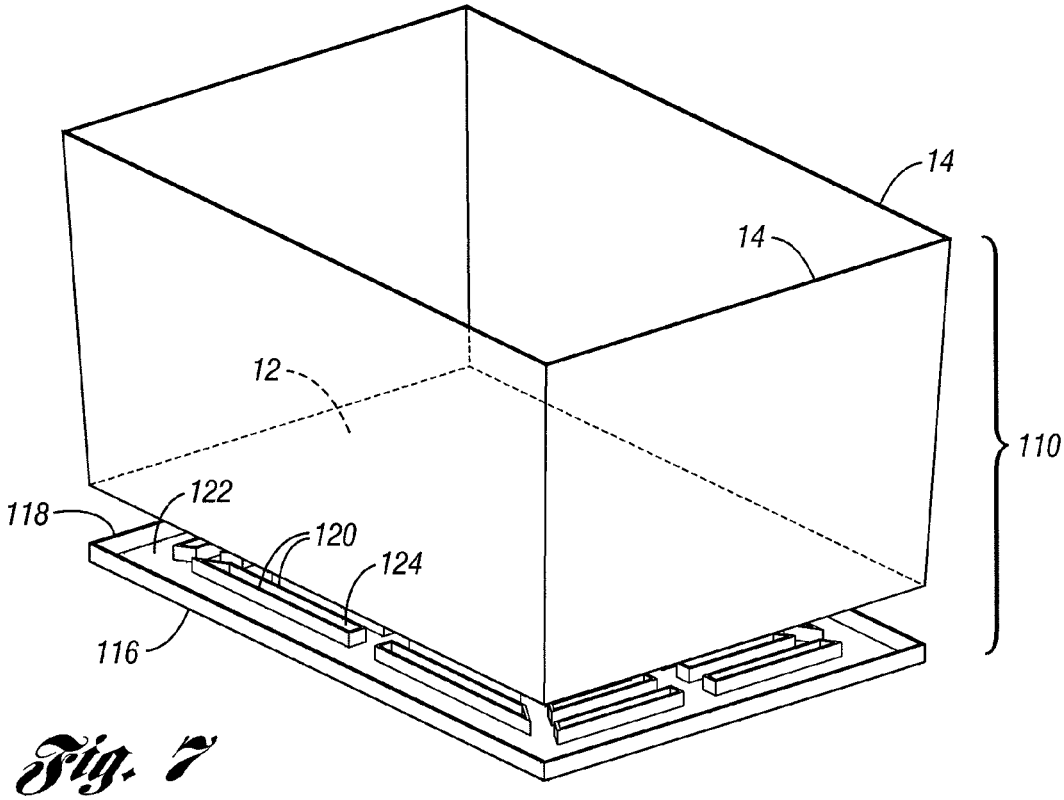
FIG. 7 is an exploded view of a container according to a second embodiment.

A container 110 according to a second embodiment is shown in FIG. 7. The floor 12 and side walls 14 are integrally molded as before. An alternate reinforcement member 116 is secured to the under side of the floor 12. The reinforcement member 116 includes a plurality of ribs 120 circumscribing openings 124 through a panel 122. A peripheral rib 118 extends about the periphery of the reinforcement member 116.

Figure 8:
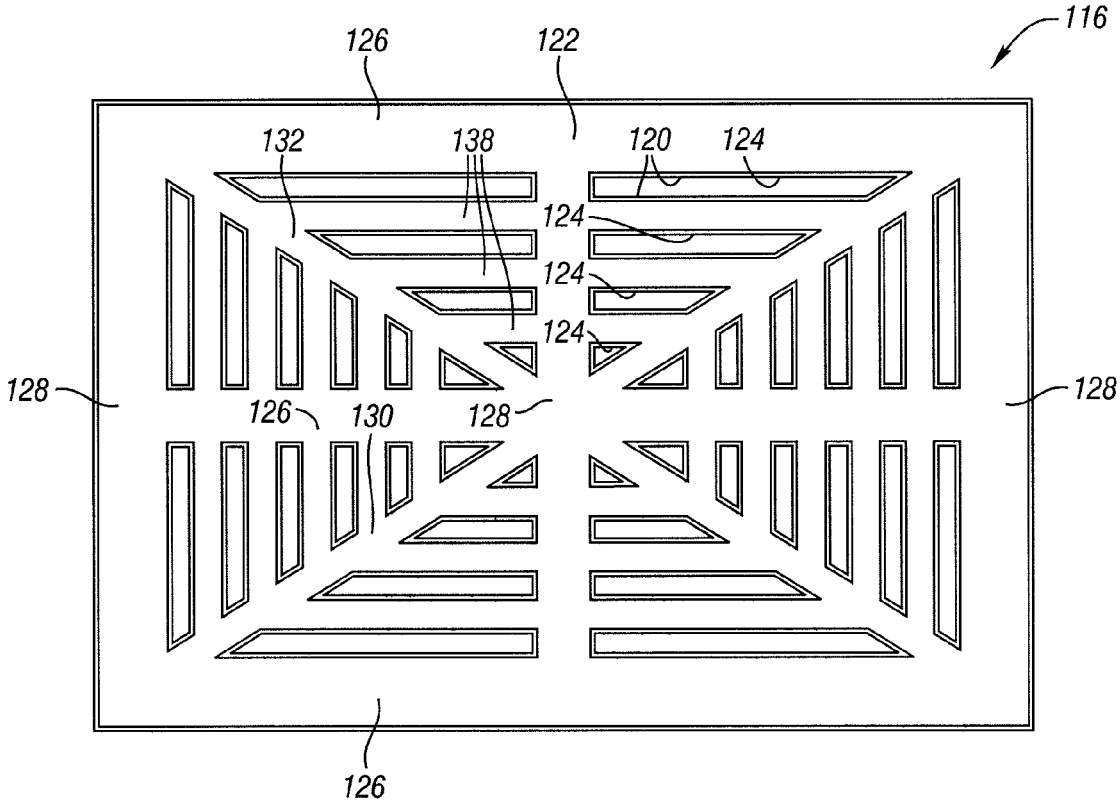
FIG. 8 is a top view of the reinforcement member of the container of FIG. 7.

The shapes and arrangements of the openings 124 and ribs 120 is shown in FIG. 8, which is a top view of the reinforcement member 116. The reinforcement member 116 can be considered to have a panel 122 having a plurality of continuous longitudinal portions 126 intersecting continuous lateral portions 128, first diagonal portions 130 and second diagonal portions 132. The remaining triangular segments are each divided by three parallel panel portions 138, which are continuous and contiguous with the adjacent portions of the panel 122. The portions 126, 128, 130, 132, 138 are defined between the openings 124, which are circumscribed by the ribs 120. Again, the pattern of ribs 120 and openings 124 in the reinforcement member 116 reinforces the container 110 without unduly increasing the weight of the container 110.

Figure 9:
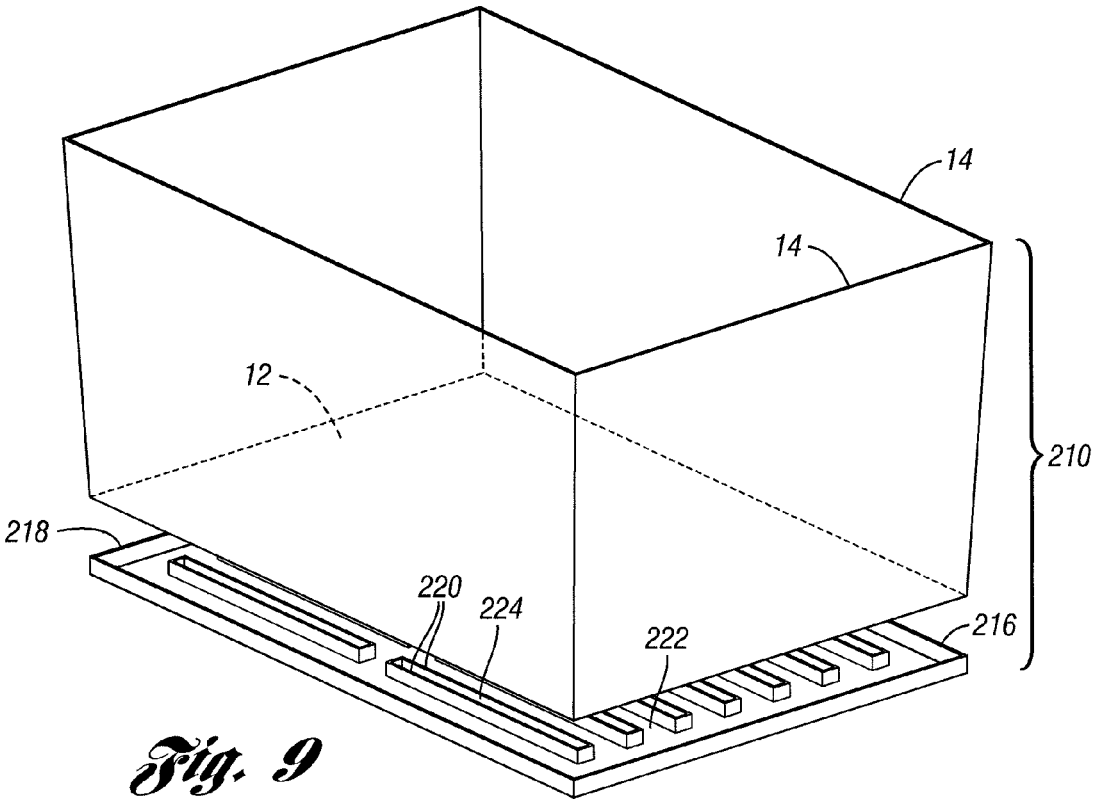
FIG. 9 is an exploded view of the container according to a third embodiment.
Figure 10:
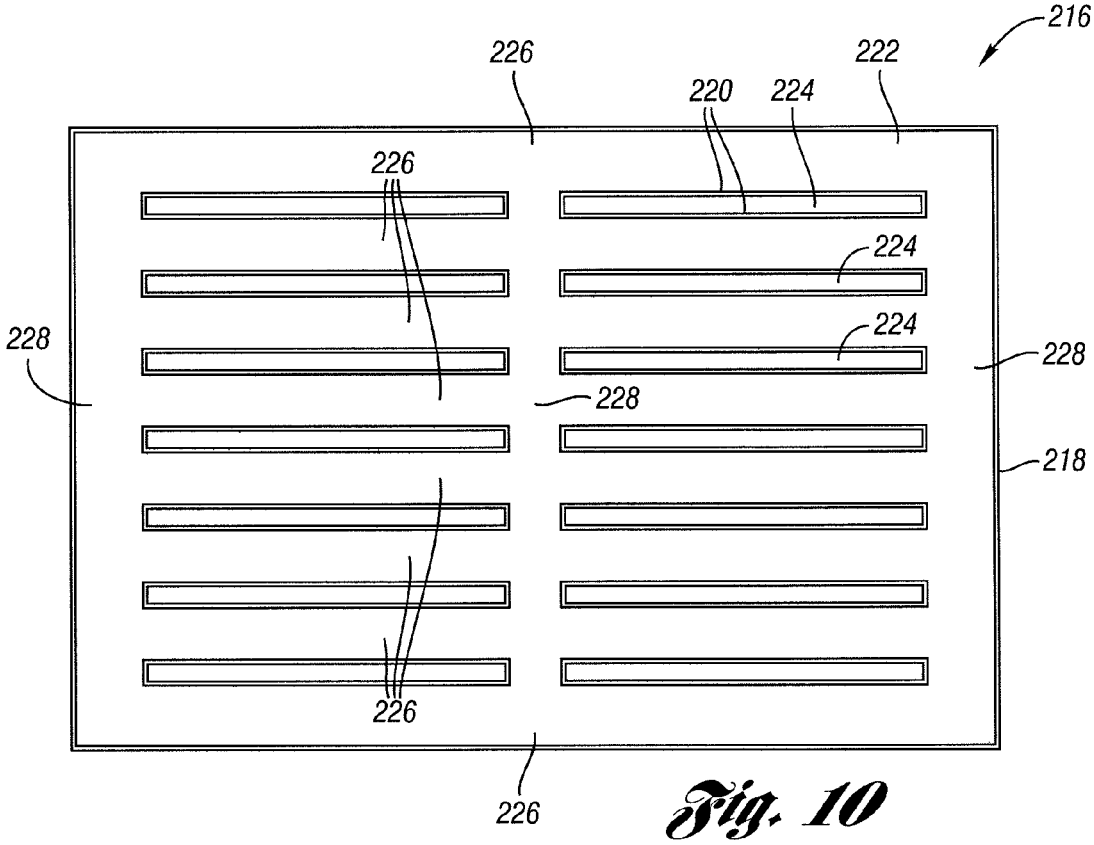
FIG. 10 is a top view of the reinforcement member of the container of FIG. 9.

A container 210 according to a third embodiment is shown in FIGS. 9 and 10. Referring to FIG. 9, the same floor 12 and side walls 14 are connected to an alternate reinforcement member 216. The reinforcement member 216 includes a peripheral rib 218 extending completely about the periphery of a panel 222. Ribs 220 extend upwardly from the panel 222, circumscribing openings 224 through the panel 222. Referring to FIG. 10, in this embodiment, the panel 222 can be described as having a plurality (in this example, eight) continuous longitudinal portions 226 intersected by a plurality (in this example, three) continuous lateral portions 228, defined by the peripheral rib 218 and the ribs 220 circumscribing the openings 224. The openings 224 are elongated and parallel to one another. The ribs 220 provide reinforcement primarily longitudinally, i.e. across the longer dimension of the container 210. Again, the reinforcement member 216 increases the strength and stiffness of the container 210, without unduly increasing its weight. Optionally, drainage holes (not shown) through the floor 12 could be provided in alignment with the openings 224.

Figure 11:
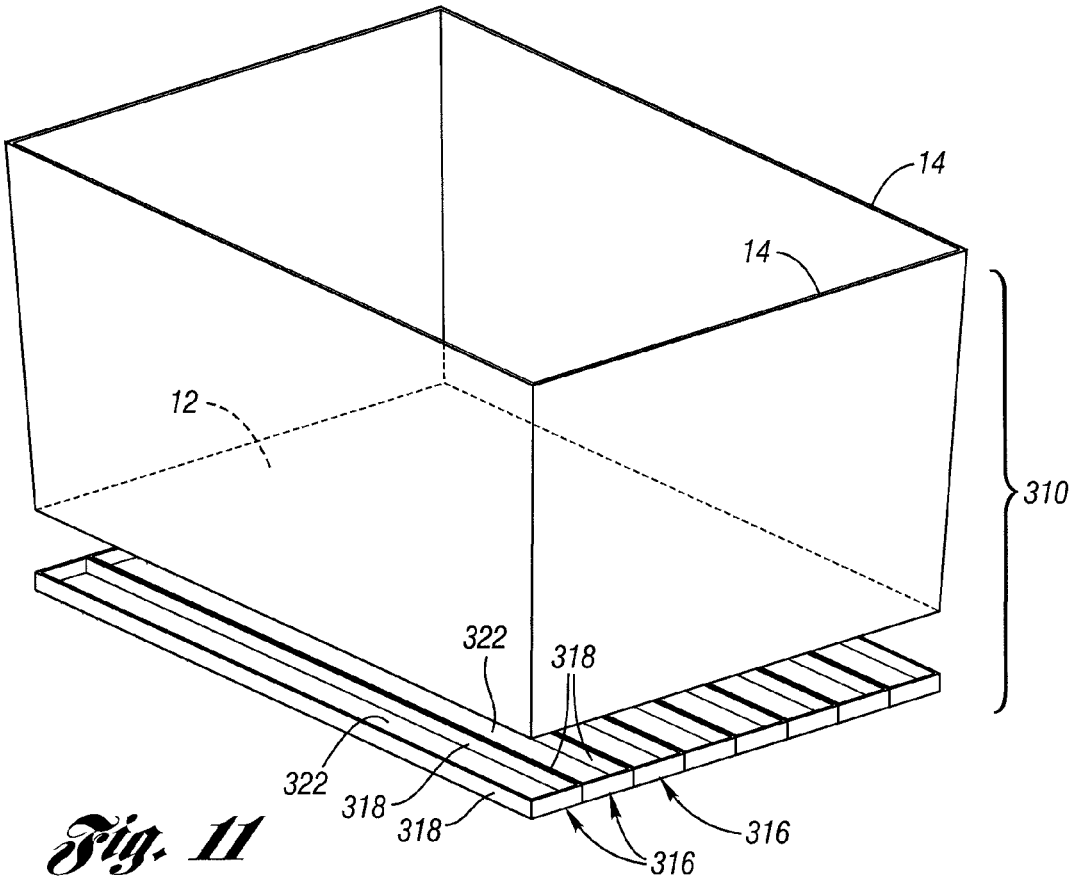
FIG. 11 is an exploded view of a container according to a fourth embodiment.
Figure 12:
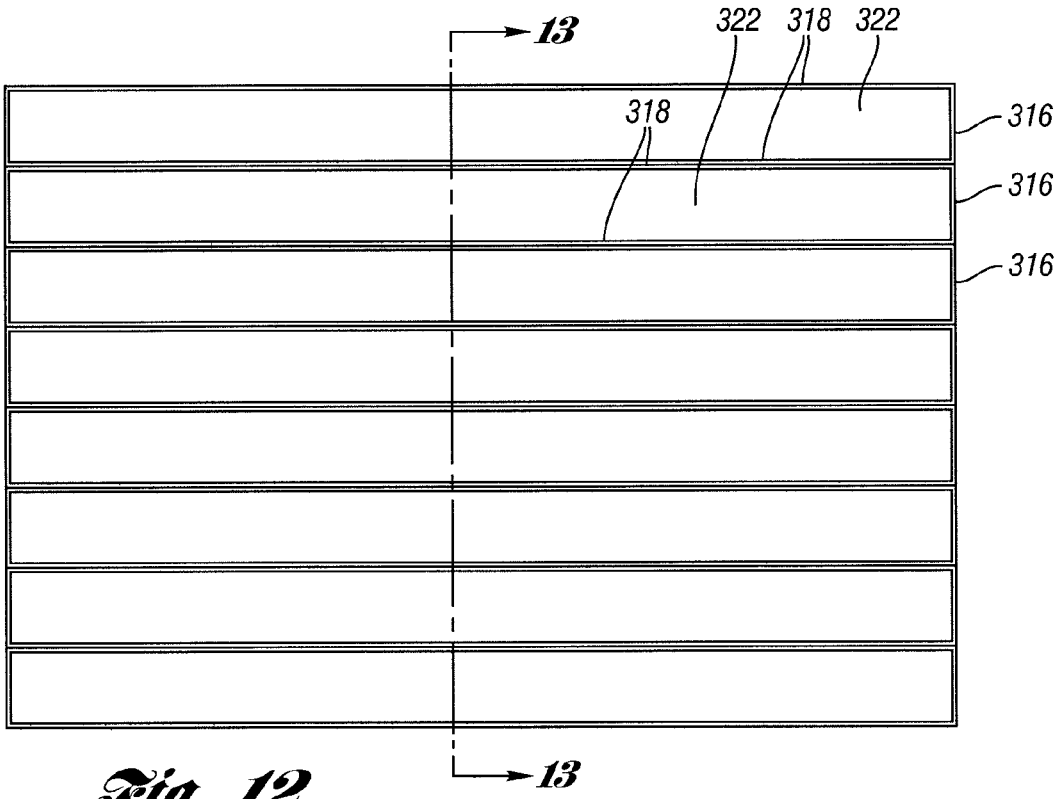
FIG. 12 is a top view of the reinforcement members of the container of FIG. 11.
Figure 13:
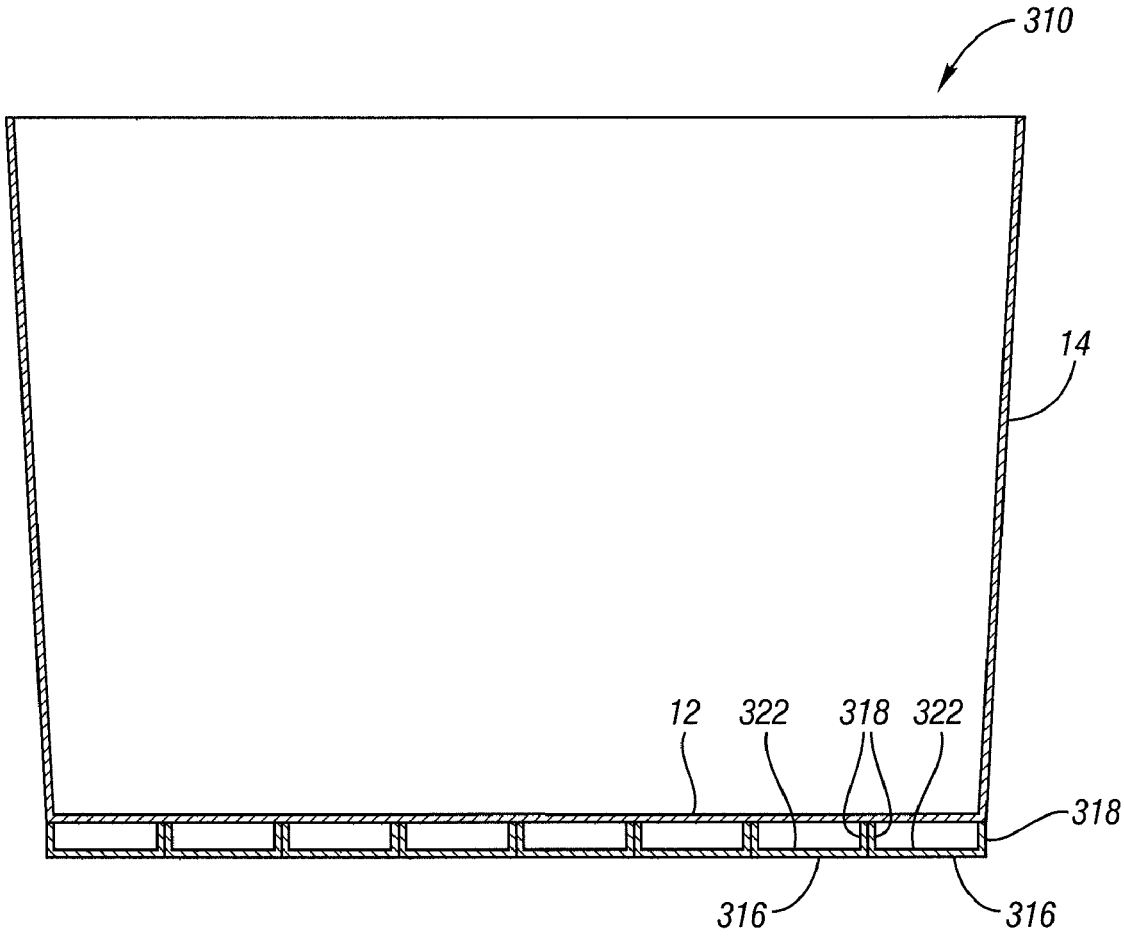
FIG. 13 is a section view taken along 13-13 of FIG. 12 through the assembled container of FIG. 11.

A container 310 according to a fourth embodiment is shown in FIG. 11-13. The same floor 12 and side walls 14 are connected to a plurality of elongated reinforcement members 316. Each reinforcement member 316 includes a panel 322 and a peripheral rib 318. Adjacent peripheral ribs 318 of adjacent reinforcement members 316 abut one another, as shown in FIG. 12. The ribs 318 are then secured to the underside of the floor 12, as shown in FIG. 13. In the example shown, the reinforcement members 316 extend the entire length of the container 310. This embodiment provides a lower surface of the container 310 that is completely flush.

In all of the embodiments described above, the reinforcement members 16, 116, 216, 316 are secured to the floor 12 by vibration welding, hot plate welding, adhesives, ultrasonic welding or other suitable techniques. Other shapes, rib patterns and hole patterns could also be used. The reinforcement members 16, 116, 216, 316 could alternatively be secured to the upper surface of the floor 12, in the interior of the container 310. Additionally, it is also possible to integrally mold the ribs 18, 118, 218, 318, 20, 120, 220, with the under side of the floor 12 and subsequently secure the panel 22, 122, 222, 322 to the ribs. Alternatively, the ribs could be integrally molded on the upper surface of the floor 12 and subsequently secured to the panels in the interior of the containers.

If the reinforcement members were secured by hot plate welding, it would be preferable to form a portion of each rib integrally with the reinforcement member and a portion integrally with the mating surface of the floor 12. The hot plate would then contact the two portions of each rib (but not the panels) and the portions would then be joined to form the ribs.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. Alphanumeric identifiers for steps in method claims are for ease of reference in dependent claims and do not signify a required sequence unless otherwise stated.

What is claimed is:

1. A container comprising:

a bottom floor structure;

a plurality of side walls extending upwardly from the bottom floor structure;

the bottom floor structure including a first panel and a second panel spaced vertically from the first panel, a plurality of openings formed through the second panel, a plurality of ribs integrally molded with the second panel and extending vertically from the first panel to the second panel about a periphery of each of the plurality of openings; and a peripheral rib integrally molded with the second panel and extending about the periphery of the second panel, the plurality of ribs and the peripheral rib defining on the second panel a continuous peripheral portion, a plurality of continuous lateral portions and a plurality of continuous longitudinal portions.

2. The container of claim 1 wherein the first panel is integrally molded with the plurality of side walls.

3. The container of claim 1 wherein the plurality of ribs are generally perpendicular to the first panel and the second panel and each of the plurality of ribs extends completely about the periphery of a different one of the plurality of openings.

4. A container comprising:

a bottom floor structure;

a plurality of side walls extending upwardly from the bottom floor structure;

the bottom floor structure including a first panel and a second panel spaced vertically from the first panel, a plurality of openings formed through the second panel, a plurality of ribs integrally molded with the second panel and extending vertically from the first panel to the second panel about a periphery of each of the plurality of openings, wherein the second panel includes a plurality of continuous diagonal portions defined between the plurality of ribs.

5. The container of claim 4 wherein each of the plurality of openings through the second panel is a triangular opening.

6. The container of claim 1 wherein the plurality of ribs are vibration welded to the first panel.

7. The container of claim 1 wherein each of the plurality of openings is elongated and wherein subsets of the plurality of openings are parallel to one another.

8. A container comprising:

a bottom floor structure;

a plurality of side walls extending upwardly from the bottom floor structure;

the bottom floor structure including a planar first panel and a second panel spaced from the first panel, wherein the first panel is integrally molded with the plurality of side walls, the side walls extending upwardly from a periphery of the first panel, a plurality of openings formed through the second panel, a plurality of ribs below the first panel connecting the first panel to the second panel, wherein the plurality of ribs are integrally molded with the second panel, the second panel below the plurality of ribs, the plurality of ribs extending completely about a periphery of each of the plurality of openings and defining boundaries of each of the plurality of openings; and a peripheral rib integrally molded with the second panel and extending about the periphery of the second panel, wherein there are no ribs or portions of ribs between the first panel and the second panel other than the plurality of ribs extending completely about the periphery of each of the plurality of openings and the peripheral rib.

9. The container of claim 1 wherein the first panel extends between the ribs over the openings through the second panel.

10. The container of claim 8 wherein the first panel extends between the ribs over the openings through the second panel.

11. The container of claim 4 wherein the first panel is integrally molded with the plurality of side walls.

12. The container of claim 4 further including a peripheral rib integrally molded with the second panel and extending about the periphery of the second panel.

13. The container of claim 4 wherein the plurality of ribs are generally perpendicular to the first panel and the second panel and each of the plurality of ribs extends completely about the periphery of a different one of the plurality of openings.

14. The container of claim 4 wherein the plurality of ribs are vibration welded to the first panel.

15. The container of claim 4 wherein the first panel extends between the ribs over the openings through the second panel.

16. The container of claim 15 wherein the first panel extends between the ribs over the openings through the second panel.

17. The container of claim 8 wherein the plurality of ribs are vibration welded to the first panel.

18. The container of claim 17 wherein the first panel extends between the ribs over the openings through the second panel.

19. The container of claim 8 wherein there are no ribs between the first panel and the second panel that are also between any one of the plurality of ribs extending completely about the periphery of each of the plurality of openings and the peripheral rib.

20. The container of claim 8 wherein each of the plurality of ribs extending completely about the periphery of each of the plurality of openings and the peripheral rib has a surface exposed to an exterior of the container.

* * * * *